US009182716B2

(12) United States Patent
Yamamoto

(10) Patent No.: US 9,182,716 B2
(45) Date of Patent: Nov. 10, 2015

(54) IMAGE FORMING APPARATUS

(75) Inventor: Koyo Yamamoto, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 213 days.

(21) Appl. No.: 13/028,299

(22) Filed: Feb. 16, 2011

(65) Prior Publication Data

US 2011/0236100 A1 Sep. 29, 2011

(30) Foreign Application Priority Data

Mar. 25, 2010 (JP) ..... 2010-070143

(51) Int. Cl.
*G03G 15/00* (2006.01)
*G03G 15/23* (2006.01)

(52) U.S. Cl.
CPC ..... *G03G 15/234* (2013.01); *G03G 15/6561* (2013.01); *G03G 15/235* (2013.01)

(58) Field of Classification Search
CPC G03G 15/234; G03G 15/6561; G03G 15/235
USPC ..... 399/401, 392, 394, 125
See application file for complete search history.

(56) References Cited

U.S. PATENT DOCUMENTS

| | | | | |
|---|---|---|---|---|
| 4,914,485 | A | 4/1990 | Emori | |
| 6,101,350 | A * | 8/2000 | Suzuki et al. | 399/113 |
| 7,242,874 | B2 | 7/2007 | Tsusaka | |
| 7,398,048 | B2 * | 7/2008 | Tomatsu | 399/401 |
| 2005/0220461 | A1 | 10/2005 | Tsusaka | |
| 2006/0113725 | A1 | 6/2006 | Ito | |
| 2006/0120754 | A1 * | 6/2006 | Suzuki et al. | 399/111 |
| 2006/0193666 | A1 | 8/2006 | Tomatsu | |
| 2007/0048008 | A1 | 3/2007 | Kamimura | |
| 2007/0147920 | A1 | 6/2007 | Shimizu | |
| 2009/0060568 | A1 * | 3/2009 | Ishikawa et al. | 399/111 |
| 2009/0269113 | A1 | 10/2009 | Ogawa | |

FOREIGN PATENT DOCUMENTS

| | | |
|---|---|---|
| CN | 101377646 | 3/2009 |
| JP | 2001060057 A | 3/2001 |
| JP | 2005283887 A | 10/2005 |
| JP | 2005292357 A | 10/2005 |
| JP | 2006-151609 | 6/2006 |
| JP | 2007058082 A | 3/2007 |
| JP | 2007264169 A | 10/2007 |
| JP | 2009-058740 | 3/2009 |
| JP | 2009263103 A | 11/2009 |

OTHER PUBLICATIONS

Extended European Search Report issued in corresponding European Patent Application 11000923.0 dtd Aug. 20, 2012.

(Continued)

*Primary Examiner* — Matthew G Marini
(74) *Attorney, Agent, or Firm* — Banner & Witcoff, Ltd.

(57) ABSTRACT

An image forming apparatus is provided. The image forming apparatus includes: a conveying path that includes a first U shape portion; a registration roller; and a inverting path including a second U shape portion joining with an upstream position of the registration roller. The conveying path includes a downward slope portion that runs obliquely down from a topmost position of the first U shape portion toward a nipping position of the registration roller; and wherein the topmost position, a joining position in which the conveying path is connected to the inverting path and the nipping position get lower, in this order, in a vertical direction.

4 Claims, 3 Drawing Sheets

(56) References Cited

OTHER PUBLICATIONS

Notification of Reasons for Refusal for Japanese patent application No. 2010-070143 mailed Feb. 14, 2012.

Office Action issued in corresponding Chinese Patent Application No. 201110060209.3 mailed Mar. 29, 2013.

Office Action issued in corresponding Chinese Patent Application No. 201110060209.3 mailed Nov. 14, 2013.

* cited by examiner

IMAGE FORMING APPARATUS

CROSS REFERENCE TO RELATED APPLICATION

The present application claims priority from Japanese Patent Application No. 2010-070143, which was filed on Mar. 25, 2010, the disclosure of which is herein incorporated by reference in its entirety.

TECHNICAL FIELD

The apparatuses and devices consistent with the invention relate to an image forming apparatus that forms image on both side of a recording sheet.

BACKGROUND

An image forming apparatus, which is configured to perform double-side printing, has therein conveying and inverting paths. The conveying path is a path for single side printing of a sheet (a recording sheet) along which the sheet from a sheet feeding tray is turned in a U shape at a front side of the image forming apparatus and then is conveyed via a photosensitive drum and then out of a housing thereof. The inverting path is a path for forming an image on the other non-printed surface of the sheet along which the sheet after the single side printing is inverted front to back and then conveyed to an upstream side of the photosensitive drum.

SUMMARY

In the image forming apparatus described above, however, a conveying path following the U shape turn portion and the photosensitive drum extends substantially horizontally. Accordingly, it is necessary to install a process cartridge including the photosensitive drum above the conveying path extending substantially horizontally, and, consequently, the image forming apparatus becomes larger in a vertical direction.

Therefore, the invention has an object to provide an image forming apparatus which becomes smaller in the vertical direction.

According to an illustrative aspect of the present invention, there is provided an image forming apparatus which forms an electrostatic latent image on a photosensitive member, develops the electrostatic latent image on the photosensitive member into a visible image by developer and transfers the visible image to a recording sheet, the image forming apparatus comprising: a conveying path that includes a first U shape portion at which the recording sheet moving from a recording sheet accommodating unit installed at a lower section of a housing toward one end of the housing turns in a U shape toward the other end of the housing; the conveying path conveying the recording sheet from the recording sheet accommodating unit via a region corresponding to the photosensitive member and then out of the housing; a registration roller that is disposed at an upstream position of the photosensitive member in the conveying path and regulates a tip end of the recording sheet moving toward the photosensitive member; and an inverting path that is a path along which the recording sheet returns from a downstream position of the photosensitive member in the conveying path to an upstream position of the registration roller in the conveying path, the inverting path including a second U shape portion joining with the upstream position of the registration roller, wherein the conveying path includes a downward slope portion that runs obliquely down from a topmost position of the first U shape portion toward a nipping position of the registration roller; and wherein the topmost position, a joining position in which the conveying path is connected to the inverting path and the nipping position get lower, in this order, in a vertical direction.

In accordance with the invention, the conveying path includes the downward slope portion running obliquely down from a topmost position of the first U shape portion toward the nipping position of the registration roller. In this way, when a cross-section of a region above the downward slope portion 38C is viewed, a substantially triangular space is formed in the region. Accordingly, a part(s) (a process cartridge in an embodiment described below) included in the image forming apparatus may be disposed into the triangular space. As a result, the image forming apparatus may become smaller in the vertical direction.

In accordance with the invention, the image forming apparatus can be smaller in the vertical direction.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

A structure of a laser printer 1 as one example of an image forming apparatus according to one embodiment will be described in details with reference to the drawings. Meanwhile, in following descriptions, a schematic strucuture of the laser printer 1 will first described and then the features of the invention will be described in details.

Figure 1:
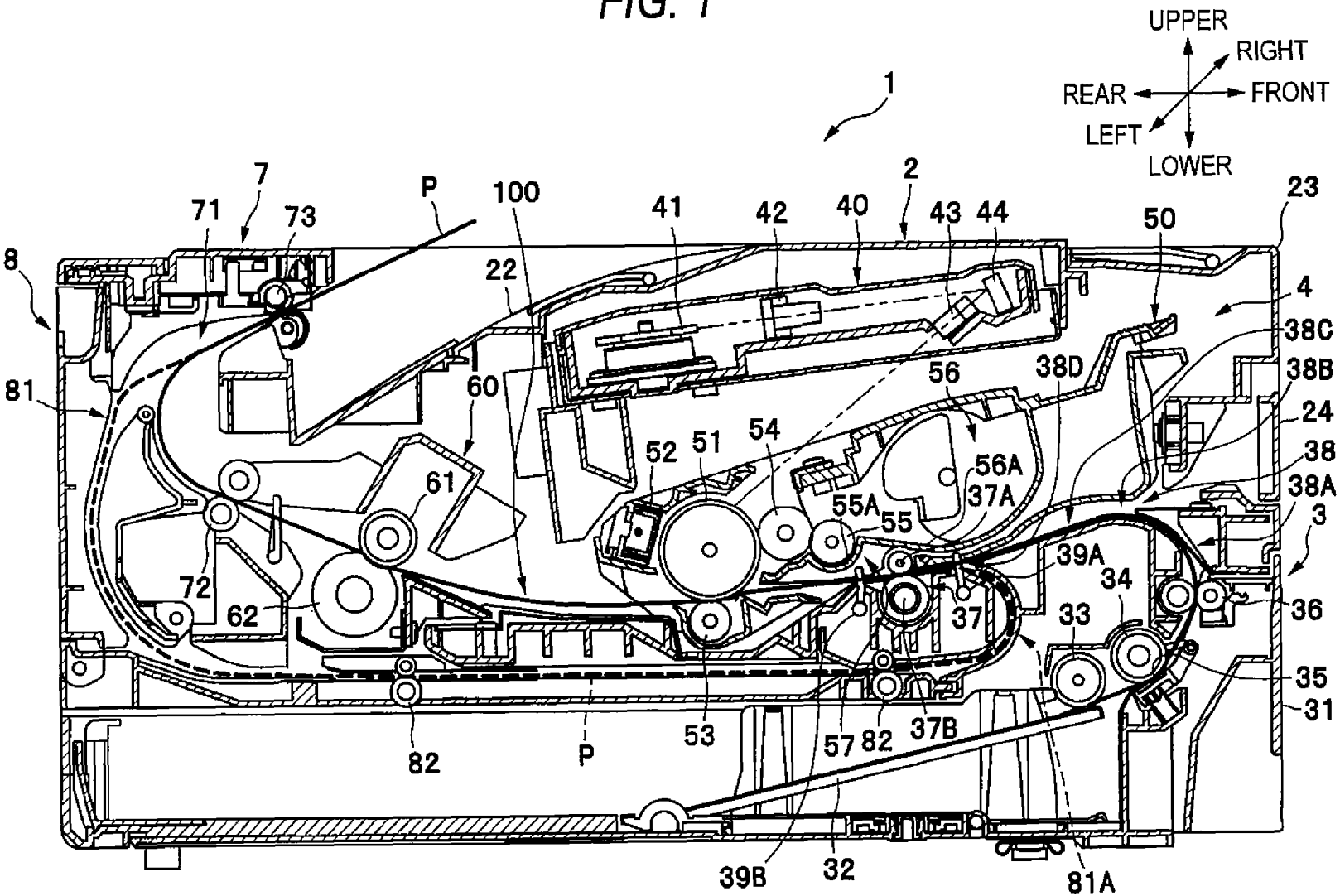
FIG. 1 is a cross-sectional view of a laser printer as one example of an image forming apparatus according to one embodiment of the invention.

Directions as mentioned below are set to be relative to a user of the laser printer 1. That is, a right side, a left side, a front side and a rear side of FIG. 1 correspond to a front side, a rear side, a left side and a right side of the user (as indicated in FIG. 1) respectively. The vertical direction of the laser printer 1 is indicated as upper and lower sides in FIG. 1. The conveying path of the sheet P as one example of a recording sheet includes upstream side and downstream side paths in the conveying direction of the sheet P.

<Entire Structure of the Laser Printer>

As shown in FIG. 1, the laser printer 1 is configured to perform the double-side printing of the sheet P and includes within a housing 2 thereof a feeder unit 3, an image forming unit 4, a sheet discharge unit 7 and an inverting unit 8.

The housing 2 has at a front side thereof a front cover 23 which gets open when a process cartridge 50 described later is attached/detached (see FIG. 3). A manual feed tray 24 on which a manually-fed sheet P will be placed is rotatably installed in the front cover 23 (see FIG. 2).

The feeder unit 3 feeds the sheet P to the image forming unit 4 and is installed in a lower section of the housing 2. The feeder unit 3 includes a sheet feeding tray 31 as one example of a recording-sheet accommodating unit, a sheet urging plate 32, a feeder roller 33, a separation roller 34, a separation pad 35, a registration roller 37, and a supplying path 38.

The registration roller 37 is disposed at an upstream side of a photosensitive drum 51 (as one example of a photosensitive member) in the supplying path 38 and regulates, in its rotation/stop state, a tip end of the sheet P moving toward the photosensitive drum 51. The supplying path 38 is a path along which the sheet P sent by the feeder roller 33 is guided to the image forming unit 4, to be specific, into between the photosensitive drum 51 and a transfer roller 53. The supplying path 38 extends obliquely upward to front from the feeder roller 33 and then turns in a U shape so as to run toward between the photosensitive drum 51 and a transfer roller 53.

Meanwhile, details of the supplying path 38 and the registration roller 37 will be described later.

The sheet(s) accommodated in the sheet feeding tray 31 moves toward the feeder roller 33 by the sheet urging plate 32 and then is sent by the feeder roller 33. The sent sheet(s) P is separated on a basis of one piece by the separation roller 34 and separation pad 35 and then is conveyed, with the conveying roller 36 and the registration roller 37, through the supplying path 38 to the image forming unit 4, to be specific, into between the photosensitive drum 51 and the transfer roller 53.

The image forming unit 4 forming an image on the fed sheet P is installed above the feeder unit 3 (the sheet feeding tray 31). The image forming unit 4 includes an exposure device 40, the process cartridge 50 and a fixing device 60.

The exposure device 40 is installed at an upper section of the housing 2 and includes a laser emitting unit (not shown), a rotatably-driven polygon mirror 41, lenses 42, 43 and a reflector 44. Laser light (refer to two-dots chain lines) based on image data and emitted from a laser source reflects from or passes through the polygon mirror 41, the lens 42, the reflector 44 and the lens 43 in this order and then scans, with high speed, a surface of the photosensitive drum 51.

The process cartridge 50 is disposed under the exposure device 40. The process cartridge 50 is configured in an exchangeable manner so as to be attached or detached to or from the housing 2 through an opening generated by opening the front cover 23 (see FIG. 3) installed in the housing 2. The process cartridge 50 includes the photosensitive drum 51, a charging device 52, a transfer roller 53, a developing roller 54, a supply roller 55 and a developer accommodating part 56 accommodating the developer.

The fixing device 60 is installed in the rear side of the process cartridge 50 and includes a heating roller 61 and a pressing roller 62 facing away the heating roller 61 so as to press the heating roller 61.

In the image forming unit 4, the surface of the photosensitive drum 51 is uniformly charged by the charging device 52 and then is subjected to the high-speed scanning with the laser light from the exposure device 40, so that an electrostatic latent image is formed on the photosensitive drum 51. The developer in the developer accommodating part 56 is supplied to the developing roller 54 by the supply roller 55 so as to be held on the developing roller 54.

Then, the developer held on the developing roller 54 is supplied onto the electrostatic latent image on the photosensitive drum 51, so that the electrostatic latent image becomes a visible image (that is, a visible image is developed) and hence the developer image (the visible image) is formed on the photosensitive drum 51. That is, the supply roller 55 supplies the developer through the developing roller 54 onto the photosensitive drum 51.

Thereafter, the sheet P fed from the feeder unit 3 is conveyed to between the photosensitive drum 51 and the transfer roller 53 and as a result the developer image on the photosensitive drum 51 is transferred to the sheet P. Next, the sheet P is conveyed to between the heating roller 61 and pressing roller 62 and in turn the transferred developer image is thermally fixed onto the sheet P.

The sheet discharge unit 7 discharges out of the housing 2 the sheet P on which the developer image has been thermally fixed (or the image has been formed). The sheet discharge unit 7 includes a discharging path 71, a conveying roller 72 and a discharging roller 73.

The discharging path 71 make the direction of the sheet P delivered from the image forming unit 4 (the fixing device 60) turn in a curved shape so that the sheet P is guided toward the front side and then out of the housing 2.

The discharging roller 73 is installed near an exit end of the discharging path 71 and is configured to rotate in a forward or reverse direction with a predetermined control method. To be specific, the discharging roller 73 is configured so as to discharge, in its forward directional rotation, the sheet P out of the housing 2, whereas so as to convey, in its reverse directional rotation, the sheet P toward the inverting unit 8.

In the sheet discharge unit 7, the sheet P (refer to a solid line) discharged from the image forming unit 4 is conveyed along the discharging path 71 by the discharging roller 72 so as to run obliquely upward to the rear side and then turn toward the front side in a curved shape and then run toward the discharging roller 73. Then, if only the single-side printing is carried out or the double-side printing has been finished, the sheet P is discharged out of the housing 2 with the forward directional rotation of the discharging roller 73 and then is laid down on the sheet discharging tray 22.

On the other hand, if the other non-printed side of the sheet P is to be printed, the sheet P moves toward the external of the housing 2 with the forward directional rotation of the discharging roller 73. Then, the discharging roller 73 starts to reversely rotate before an entirety of the sheet P is completely discharged out of the housing 2. Next, the sheet P is drawn again into the housing 2 and then is guided to the inverting unit 8 (inverting path 81) described later and then is conveyed to the image forming unit 4 (refer to a broken line).

<Structure of the Inverting Unit>

The inverting unit 8 has, if the other non-printed side of the sheet P is to be printed, the sheet P inverted front to back so as to be conveyed to the image forming unit 4 and, to this end, includes an inverting path 81 and an inverting roller 82.

The inverting path 81 guides the sheet P when the discharging roller 73 begins to rotate reversely and guides the sheet P toward the image forming unit 4. The details of the inverting path 81 will be described later.

In the inverting unit 8, the sheet P (refer to the broken line) conveyed when the discharging roller 73 begins to rotate reversely is conveyed along the inverting path 81 and then is sent toward the supplying path 38 again and then conveyed to the image forming unit 4. Thereafter, the sheet P (refer to the solid line) is printed, on its rear face, by the image forming unit 4 and then is discharged out of the housing 2 by the discharging part 7 and then is laid down on the sheet discharging tray 22.

<Structure Around a Conveying Path>

A conveying path will be described in details together with the structure around the conveying path.

As shown in FIG. 1, the conveying path 100 is a path extending from the sheet feeding tray 31 toward the sheet discharging tray 22 in a S shape and includes the supplying path 38 as mentioned above and the discharging path 71. That is, the conveying path 100 includes a first U shape portion 38A at which the sheet P moving from the sheet feeding tray 31 installed at the lower section of the housing 2 toward the front side (one end) of the housing 2 starts to be turned, in a U shape, toward the rear side (the other end) of the housing 2; and further conveys the sheet P turned in the U shape via the region corresponding to the photosensitive drum 51 and then out of the housing 2.

Further, the conveying path 100 includes a downward slope portion 38C running obliquely down from a topmost position of the first U shape portion 38A toward a nipping (sandwiching) position of the registration roller 37. In this way, when the cross-section of the region above the downward slope portion 38C is viewed, a substantially triangular space is formed in the region. Accordingly, the process cartridge 50 may be disposed into the triangular space and as a result the laser printer 1 may become smaller in the vertical direction.

Furthermore, the topmost position 38B of the first U shape portion 38A, a joining position 38D in which the inverting path 81 is connected to a conveying path (supplying path 38), and the nipping position of the registration roller 37 get lower in the vertical direction in this order. In this way, R shapes of the first U shape portion 38A and a second U shape portion 81A described later become comparatively larger. Accordingly, it is possible to convey smoothly into the nipping position the sheet P conveyed from the sheet feeding tray 31 and the sheet P conveyed via the inverting path 81.

The inverting path 81 is a path along which the sheet P turns back from the discharging path 71 (belonging to a downstream side of the photosensitive drum 51 in the conveying path 100) to an upstream side of the registration roller 37. The inverting path 81 joins with the downward slope portion 38C of the supplying path 38 which is located at the upstream side of the registration roller 37. The inverting path 81 has, just before joining with the supplying path 38, the second U shape portion 81A making the sheet P turn in the U shape.

A radius of the first U shape portion 38A is set to become larger than a radius of the second U shape portion 81A. In this way, a thick sheet P such as a post card or cardboard may be conveyed along the conveying path 100 well and hence a single side printing of such a thick sheet may be possible.

The registration roller 37 includes first and second registration rollers 37A, 37B which are disposed from each other so as to hold the sheet P conveyed thereto in an appropriate pressure. Meanwhile, one of the first and second registration rollers 37A, 37B is a driving roller and the other is a driven roller which rotates following the rotation of the driving roller.

The first registration roller 37A is rotatably installed in the process cartridge 50 and the second registration roller 37B is rotatably installed in the housing 2. In this way, when the process cartridge 50 is removed, if the sheet P is jammed into between the rollers 37A, 37B, from the housing 2, the first registration roller 37A is removed together with the process cartridge 50 and hence only the second registration roller 37B remains in the housing 2 (see FIG. 3). Therefore, the problem that the sheet P is jammed into between the rollers 37A, 37B may be solved easily.

The first registration roller 37A is disposed at an upwardly depressed portion 57 formed on the process cartridge 50. In this way, the process cartridge 50 may be disposed as near the supplying path 38 as possible and hence the laser printer 1 becomes smaller in the vertical direction.

The depressed portion 57 is formed with a roller wall portion 55A with a substantially arc shape along a lower circumference of a cross-section of the supply roller 55; and a lower wall portion 56A with a substantially arc shape along a lower circumference of a cross-section of the developer accommodating part 56. To be specific, the roller wall portion 55A is in a continuous contact with the lower wall portion 56A so that the depressed portion 57 is formed.

The first registration roller 37A has a partial and horizontal superposition with the supply roller 55. That is, the first registration roller 37A and the supply roller 55 are placed at substantially the same position in the vertical direction. Accordingly, the size of the laser printer 1 becomes smaller in this structure as compared to the structure in which the supply roller 55 is disposed at a more upper position than the first registration roller 37A.

An upstream side sensor 39A is disposed at the upstream side of the registration roller 37 and a downstream side sensor 39B is disposed at a downstream side of the registration roller 37. The upstream side sensor 39A is disposed at a higher position in the vertical direction than the downstream side sensor 39B.

The upstream side sensor 39A detects, before the sheet enters into the registration roller 37, a passage of the tip end of the sheet P in order to determine when beginning to rotate the registration roller 37. The downstream side sensor 39B detects, before the sheet enters into between the photosensitive drum 51 and the transfer roller 53, a passage of a rear end of the sheet P in order to determine a scanning timing of the laser light with the exposure device 40.

The detections of the passages of the sheet P with the upstream side sensor 39A and the downstream side sensor 39B and associated operations of the registration roller 37 are as follows:

If the upstream sensor 39A detects, when the registration roller 37 is in a stop state, the passage of the tip end of the sheet P, the registration roller 37 regulates the tip end of the sheet P by keeping on being in the stop state for a predetermined time. If the predetermined time lapses, the registration roller 37 starts to rotate and thus conveys the sheet P toward the photosensitive drum 51. Then, if the downstream sensor 39B detects the passage of the rear end of the sheet P, the registration roller 37 returns to the stop state.

Figure 2:
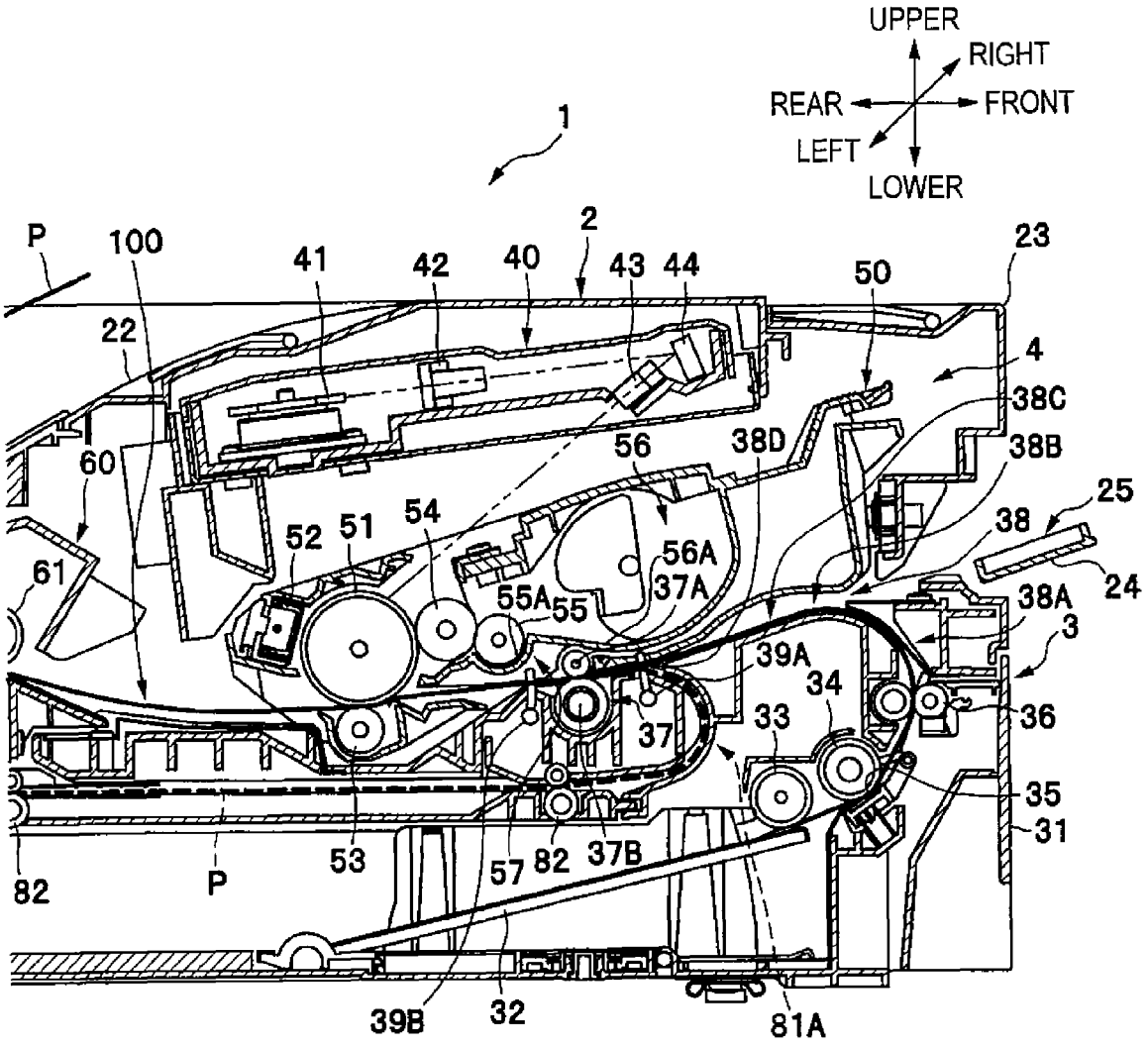
FIG. 2 is a cross-sectional view of the laser printer when a manual feed cover is open.
Figure 3:
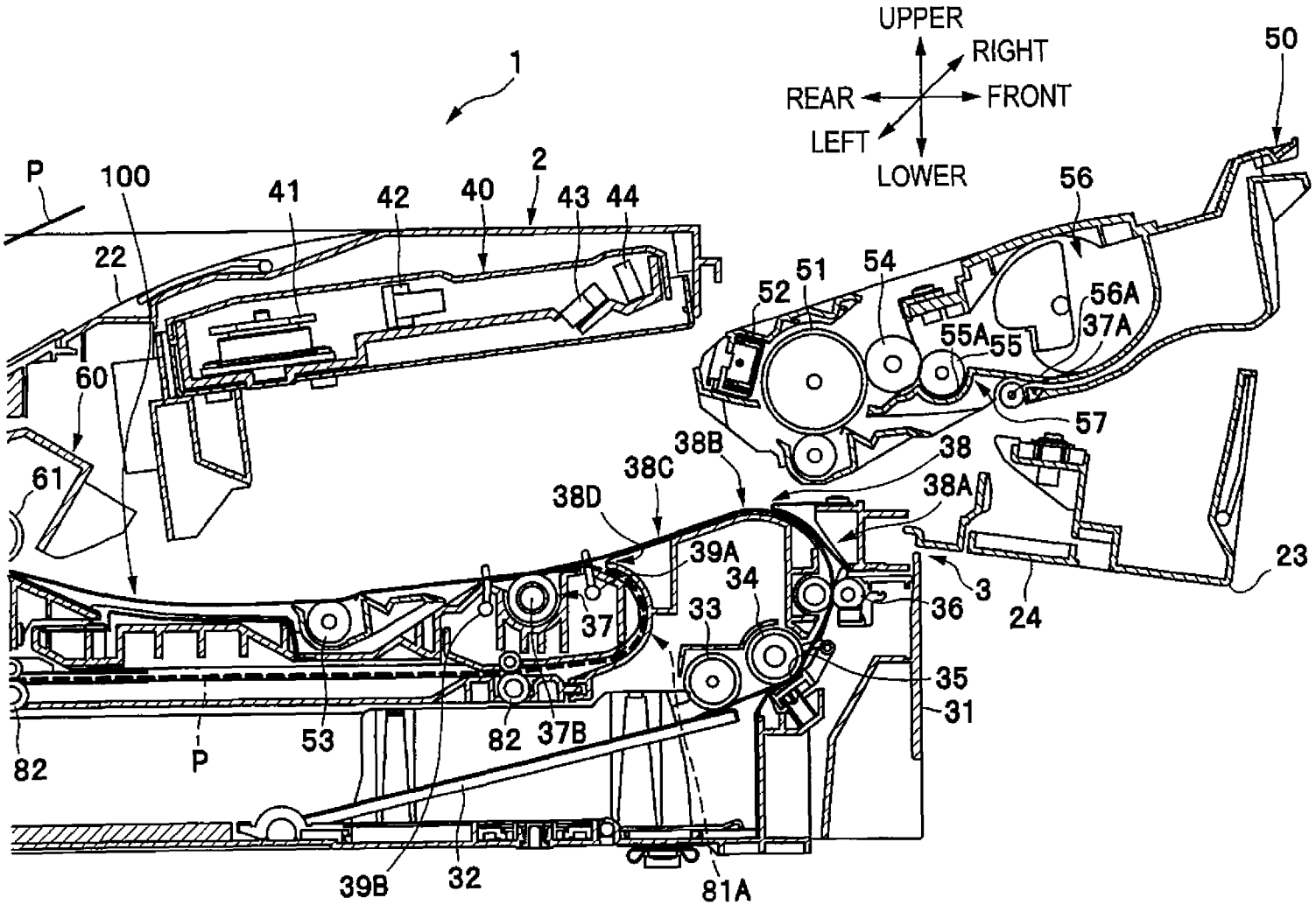
FIG. 3 is a cross-sectional view of the laser printer when a process cartridge is detached.

As shown in FIG. 2, when the manful feed tray 24 gets open, a manual feed conveying path 25 is formed to mainly convey a manual feed sheet P on and with an upper face of the manual feed tray 24. The manual feed conveying path 25 conveys the sheet P toward the topmost position 38B of the first U shape portion 38A and to this end includes a feed roller (not shown).

The manful feed conveying path 25 is parallel with the downward slope portion 38C (to be specific, is disposed in an extending line of the down slope portion 38C). In this way, it is possible to reliably convey the manual feed sheet P from the manual feed conveying path to the downward slope portion 38C of the conveying path 100.

The present embodiment accomplishes following effects:

When the cross-section of the region above the downward slope portion 38C is viewed, the substantially triangular space is formed in the region. Accordingly, the process cartridge 50 may be disposed into the triangular space. As a result, the laser printer 1 may become smaller in the vertical direction.

The radius of the first U shape portion 38A of the conveying path 100 is set to become larger than the radius of the second U shape portion 81A of the inverting path 80. In this way, the thick recording sheet P such as the post card or cardboard may be reliably conveyed along the conveying path 100.

One 37A of a pair of rollers 37A, 37B consisting of the registration roller 37 is installed in the process cartridge 50. Therefore, the problem that the sheet P is jammed into between the rollers 37A, 37B may be solved easily.

The first registration roller 37A has a horizontal superposition with the supply roller 55. As a result, the laser printer 1 may become smaller in the vertical direction.

The first registration roller 37A is placed in the upwardly depressed portion 57 formed on the process cartridge 50. Accordingly, the laser printer 1 may become smaller in the vertical direction.

The manful feed conveying path 25 is parallel with the downward slope portion 38C. In this way, it is possible to reliably or smoothly convey the manual feed sheet P from the manual feed conveying path to the downward slope portion 38C of the conveying path 100.

Although the embodiment of the invention has been described above, the invention is not limited thereto. Variations of the specific configurations may be possible without departing the spirit and scope of the invention.

For example, in the above illustrative embodiment, the photosensitive drum 51 is employed as the photosensitive member. However, the invention is not limited thereto, and a belt type photosensitive member may be used as the photosensitive member.

In the above illustrative embodiment, one example of the recording sheet includes a paper or a post card. However, the invention is not limited thereto, and one example of the recording sheet includes OHP sheet.

In the above illustrative embodiment, the attachable/detachable feed tray 31 is employed as the recording-sheet accommodating unit. However, the invention is not limited thereto, and the recording-sheet accommodating unit may include for example a depression formed in and as one body with the housing.

In the above illustrative embodiment, the black-white laser printer 1 exemplifies the image forming apparatus. However, the invention is not limited thereto, and a color printer may exemplify the image forming apparatus. Further, the image forming apparatus is not limited to the printer but may include a copying machine or a multi-functional machine.

In the above illustrative embodiment, a portion of the manual feed conveying path 25 includes the surface of the separate manual feed tray 24. However, the invention is not limited thereto, and for example the separate manual feed tray 24 is not provided but a path extending toward the conveying path through a manual feed opening formed in the wall of the housing may be used as the manual feed conveying path.

What is claimed is:

1. An image forming apparatus configured to form an electrostatic latent image on a photosensitive member, develop the electrostatic latent image on the photosensitive member into a visible image using developer and transfer the visible image to a recording sheet, the image forming apparatus comprising:

a developer accommodating unit configured to accommodate the developer, a conveying path having a first U-shaped portion at which the recording sheet, moving from a recording sheet accommodating unit installed at a lower section of a housing toward one end of the housing, turns in a U shape toward another end of the housing, the image forming apparatus configured to convey the recording sheet from the recording sheet accommodating unit through the conveying path via a region corresponding to the photosensitive member and then out of the housing;

a pair of registration rollers disposed at an upstream position of the photosensitive member in the conveying path and configured to regulate a tip end of the recording sheet moving toward the photosensitive member by holding the tip end of the recording sheet in a stopped state for a predetermined amount of time;

an inverting path along which the recording sheet returns from a downstream position of the photosensitive member in the conveying path to an upstream position of the registration rollers in the conveying path, the inverting path including a second U-shaped portion joining with the upstream position of the registration rollers; and a supply roller configured to supply the developer to the photosensitive member, a process cartridge including the photosensitive member, the process cartridge being detachably provided in the housing, the housing including a main body;

wherein one of the pair of registration rollers is provided in the main body, and the other of the pair of registration rollers is provided in the process cartridge;

wherein the pair of registration rollers is at least partially overlapped with the supply roller when viewed in a horizontal direction along the conveying path in a downstream direction, wherein the conveying path includes a downward slope portion that runs obliquely downward from a topmost position of the first U-shaped portion toward a nipping position of the registration rollers, wherein the topmost position, a joining position in which the conveying path is connected to the inverting path and the nipping position are disposed progressively lower, in this order, in a vertical direction, wherein a lower wall portion of the developer accommodating unit is continuous with a roller wall portion formed along a lower circumference of the supply roller, wherein an upwardly depressed portion is formed with the lower wall portion and the roller wall portion, and wherein at least a part each of the registration rollers is placed in the upwardly depressed portion.

2. The image forming apparatus according to claim 1, wherein a radius of the first U-shaped portion is larger than a radius of the second U-shaped portion.

3. The image forming apparatus according to claim 1, further comprising:

a manual feed conveying path, wherein the image forming apparatus is configured to convey a manual feed sheet toward the topmost position of the first U-shaped portion, wherein the manual feed conveying path is parallel with the downward slope portion of the conveying path.

4. The image forming apparatus according to claim 1, further comprising:

an upstream side sensor disposed at an upstream side of the registration rollers; and a downstream side sensor disposed at a downstream side of the registration rollers, wherein the upstream side sensor is disposed at a higher position than the downstream side sensor.

* * * * *